US005820328A

United States Patent [19]

Finnemore

[11] Patent Number: 5,820,328

[45] Date of Patent: Oct. 13, 1998

[54] INTEGRATED SYSTEM FOR REMOVAL AND REPLACEMENT OF BASKETED MATERIAL WITHIN DUCT WORK OR AIR PREHEATER ROTORS

[75] Inventor: Harlan E. Finnemore, Pocatello, Id.

[73] Assignee: ABB Air Preheater, Inc., Wellsville, N.Y.

[21] Appl. No.: 775,126

[22] Filed: Dec. 30, 1996

[51] Int. Cl.[6] ..... F27D 3/00

[52] U.S. Cl. ..... 414/150; 414/506; 414/559

[58] Field of Search ..... 414/150, 395, 414/506, 559; 254/4 R, 4 B, 4 C

[56] References Cited

U.S. PATENT DOCUMENTS

| | | | |
|---|---|---|---|
| 674,498 | 5/1901 | Dozier et al. | 414/150 |
| 2,514,752 | 7/1950 | Faulkner et al. | 414/506 |
| 4,274,788 | 6/1981 | Sutton | 414/559 X |
| 4,283,164 | 8/1981 | Reaney | 414/506 X |
| 5,154,564 | 10/1992 | Koch | 414/559 X |

*Primary Examiner*—David A. Bucci
*Attorney, Agent, or Firm*—Alix, Yale & Ristas, LLP

[57] ABSTRACT

A system for removing and replacing heat exchange baskets for radially loaded air preheaters. The system includes a platform having a horizontal upper surface for supporting the heat exchange baskets. The upper surface is substantially alignable with each basket support level such that a single platform may be used to remove or replace all of the heat exchange baskets. A tugger and tugger line are provided for providing the motive force required to move the heat exchange baskets. An engagement apparatus engages and applies the motive force to the heat exchange basket. At least one pulley is used to control the direction of movement of the tugger line and thereby direct the motive force to either push or pull the heat exchange basket.

19 Claims, 4 Drawing Sheets

INTEGRATED SYSTEM FOR REMOVAL AND REPLACEMENT OF BASKETED MATERIAL WITHIN DUCT WORK OR AIR PREHEATER ROTORS

BACKGROUND OF THE INVENTION

The present invention relates generally to rotary heat exchangers and, more specifically, to an integrated means for removing and replacing basketed material within duct work or an air preheater rotor.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a central rotor post and divided into a plurality of sector-shaped compartments by a plurality of radial partitions, known as diaphragms, extending from the rotor post to the outer peripheral shell of the rotor. These sector shaped compartments are loaded with modular heat exchange baskets which contain the mass of heat absorbent material commonly comprised of stacked plate-like elements.

Conventional heat exchange baskets may be loaded axially into the rotor from the top end (duct end) or radially through the side of the rotor. Both designs require the positioning of the heavy, bulky heat exchange baskets. The conventional method for removing and replacing radially loaded heat exchange baskets is time consuming and requires the following:

1) A temporary platform is built and set into the basket removal opening in the air preheater housing. The surface of the platform is substantially aligned with one level of the basket support grating of the air preheater.

2) The heat exchange baskets are pulled from the air preheater manually utilizing long hooked rods or with a mechanical tugger. The tugger is located in a position that allows a flat hook to be positioned beneath the basket. The tugger pulls a cable attached to the hook to pull the baskets.

3) The baskets are pulled onto the table, lifted off of the platform by some means, and removed from the area.

4) New baskets are placed on the platform and slid into the rotor manually or with the tugger. The tugger may utilize a sheath and hook to pull the basket into the rotor or a sheath and ram to push the basket into the rotor.

5) The temporary platform is disassembled and reassembled at a different level of the basket support grating for removal and replacement of additional heat exchange baskets.

SUMMARY OF THE INVENTION

The present invention relates to novel means for removing and replacing heat exchange baskets for radially loaded air preheaters. The system includes a platform having a horizontal upper surface for supporting the heat exchange baskets. The upper surface is substantially alignable with each basket support level such that a single platform may be used to remove or replace all of the heat exchange baskets. A tugger is provided for providing the motive force required to move the heat exchange baskets. A tugger line transmits the motive force from the tugger to an engagement apparatus that engages and applies the motive force to the heat exchange basket. The system includes at least one pulley to direct the motive force to either push or pull the heat exchange basket. The system is adaptable to either move the heat exchange basket from one of the basket supports of the air preheater to the upper surface of the platform or from the upper surface of the platform to one of the basket supports of the air preheater.

In one embodiment, the system comprises an integral platform cart on which the tugger, two pulleys and wheels are mounted. The cart may be used to transport the spent heat exchange baskets away from the air preheater for disposal and to transport the new heat exchange baskets to the air preheater for installation. The mounting position of the pulleys and the manner in which the tugger line is disposed through the pulleys is adapted to either push or pull the heat exchange baskets.

In a second embodiment, the platform is mounted to the basket removal opening frame. An overhead rail and trolley provide the means for removing/supplying heat exchange baskets to the platform. Similar to the first embodiment, the mounting position of the pulleys and the manner in which the tugger line is disposed through the pulleys is adapted to either push or pull the heat exchange baskets.

DESCRIPTION OF THE PREFERRED EMBODIMENT

Figure 1:
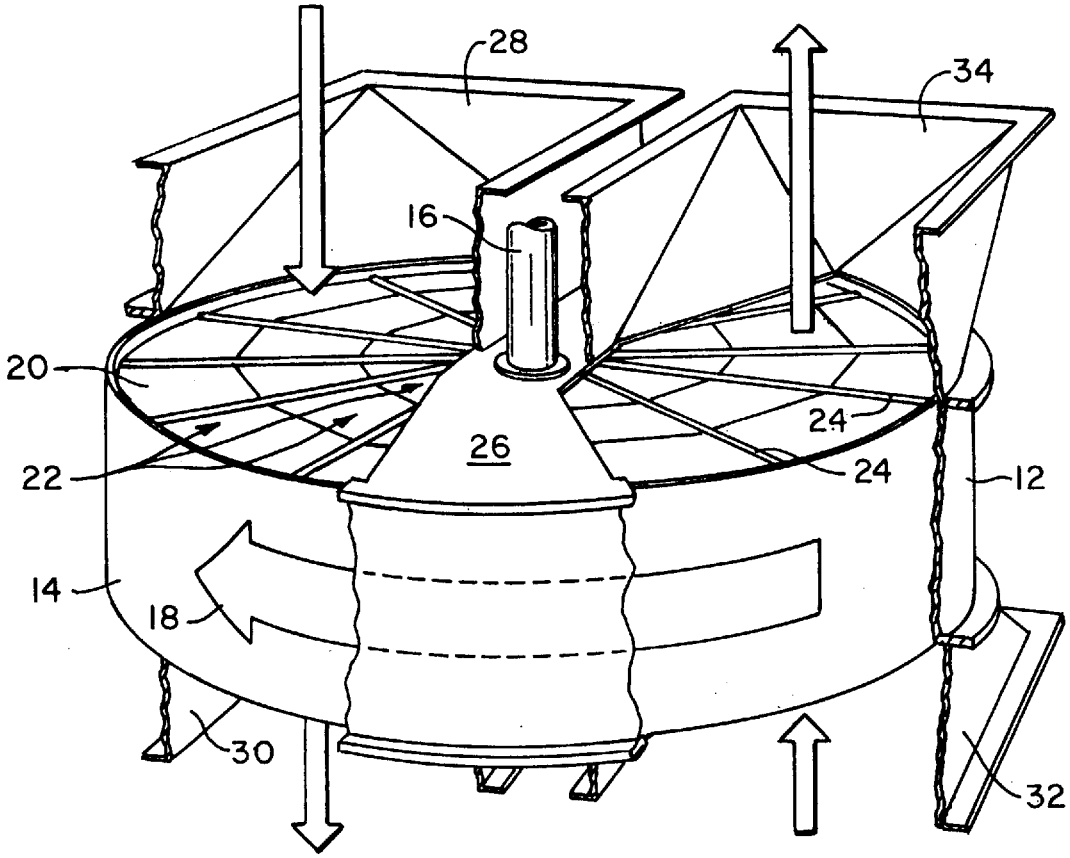
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of heat exchange baskets 22 and with each sector being defined by the diaphragms 24. The heat exchange baskets 22 contain the heat exchange surface. The housing 12 is divided by means of the flow impervious sector plate 26 into a flue gas side and an air side. A corresponding sector plate is also located on the bottom of the unit. The hot flue gases enter the air heater through the gas inlet duct 28, flow through the rotor where heat is transferred to the rotor and then exit through gas outlet duct 30. The countercurrent flowing air enters through air inlet duct 32, flows through the rotor where it picks up heat and then exits through air outlet duct 34.

Figure 2:
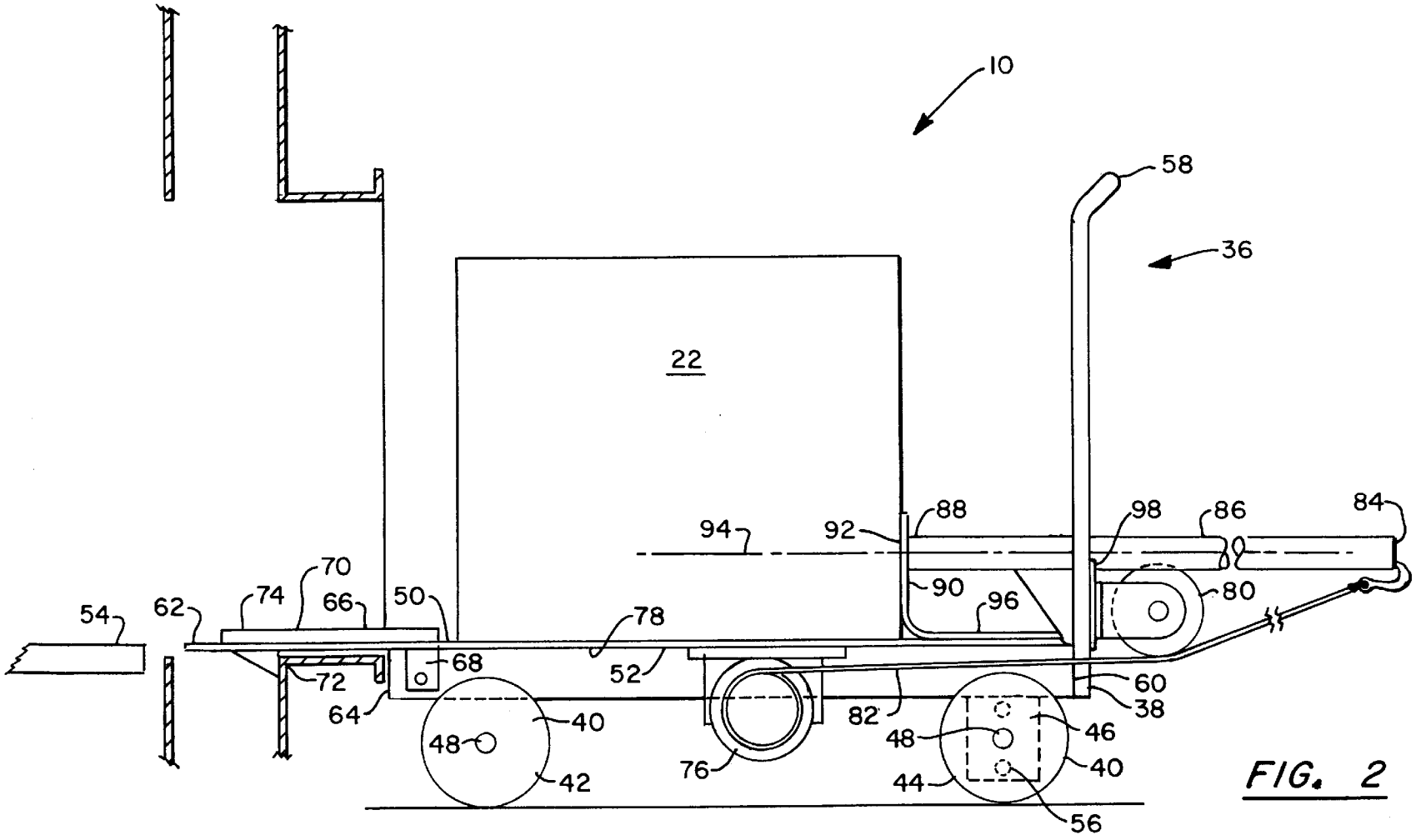
FIG. 2 is a schematic view of a first embodiment of a system for removal and replacement of basketed material within air preheater rotors with a cross section view of the air preheater basket removal opening and a portion of the air preheater basket support structure.

FIG. 2 illustrates a first embodiment 36 of an integrated system for removal and replacement of basketed material within air preheater rotors 14. This embodiment 36 includes a platform cart 38 which may be used to transport the spent heat exchange baskets 22 away from the air preheater and to transport the new heat exchange baskets 22 to the air preheater for installation. Multiple carts 38 may be used to facilitate the removal of spent heat exchange baskets and the installation of new heat exchange baskets.

Each cart 38 includes a plurality of wheels 40. The type of wheel 40 and the number of wheels 40 that are utilized are selected with regard to the weight of the heat exchange baskets 22 that will be transported. Generally, a pair of front wheels 42 and a pair of rear wheels 44 will be sufficient. Preferably, the brackets 46 that mount the wheel axles 48 to the cart 38 are adjustable so that the top surface 50 of the cart platform 52 may be substantially aligned with each level of internal basket supports 54 of the air preheater. For example, each bracket 46 may have multiple vertically spaced 56 openings for mounting the axle 48 to the bracket 46. Alternatively, other means known in the art for adjustably mounting axles may be used.

A handle 58 projects from a rear end 60 of the cart 38 for grasping and pushing or pulling the cart. An extension 62 of the cart platform 52 extends from the front end 64 of the cart 38. During removal/installation of the heat exchange baskets 22, the platform extension 62 is positioned within the air preheater to reduce the gap between the cart 38 and the internal basket supports 54 and to provide support for the heat exchange basket 22 as it is moved between the internal basket supports 54 and the cart 38. At least one hook 66 has a first end portion 68 pivotally mounted to the cart 38 near the front end 64. Preferably, a hook 66 is mounted on each side of the cart 38. The hooks 66 are operable from the handle 58 and are used to clamp the cart 38 to the air preheater structure during removal/installation operations. The hooks 66 are movable between a vertical position and a horizontal position. As shown in FIG. 1, the arm 70 of the hook 66 extends into the air preheater structure and an engagement shoulder 72 on the second end portion 74 engages an interior surface of the air preheater structure when the hook 66 is in the horizontal position. In a preferred embodiment, a spring force biases the hooks 66 to the horizontal position such that the hooks 66 are self-latching. During removal/installation operations, the front end 64 of the cart 38 is butted up against the air preheater and the hooks 66 engage the air preheater, locking the cart 38 in place.

A tugger 76 is mounted to the cart 38 to provide a means for pushing or pulling the heat exchange baskets 22 on and off of the cart 38. Preferably, the tugger 76 is mounted to and suspended from the bottom 78 of the cart platform 52 intermediate the front and rear wheels 42, 44. Alternatively, the tugger 76 may be mounted on the rear end 60 of the cart 38. The tugger 76 may be air-operated or electrically operated. If the tugger 76 is air-operated, quick connect air couplings should be provided for connection to an air supply. If the tugger 76 is electrically operated, electrical connections should be provided on the periphery of the cart 38 for connection to an electrical power supply.

At least one pulley 80 may be mounted to the cart 38 at one of a number of locations to determine how the force provided by the tugger 76 is applied to the heat exchange basket 22. As shown in FIG. 2, the pulley may be mounted to the rear end 60 of the cart 38 to direct the movement of the tugger line 82 that is mounted to the first end 84 of a ram 86. The second end 88 of the ram 86 is mounted to a shoe 90. A vertically extending face plate 92 engages the outboard side of the heat exchange basket 22. The width of the face plate 92 is selected such that the face plate 92 engages a sufficient portion of the outboard surface of the heat exchange basket 22 to prevent the basket from pivoting away from the axis 94 of the ram 86. The shoe 90 may be supported by a horizontally extending portion 96 that slides along the top surface 50 of the cart platform 52, as shown in FIG. 2. Alternatively, the face plate 92 may be suspended from the heat exchange basket 22. A guide 98 mounted to the rear end 60 of the cart 38 ensures that the movement of the ram 86 and shoe 90 are directed towards the air preheater. As the tugger 76 reels in the line 82, the line 82 pulls the first end 84 of the ram 86 toward the tugger 76, whereby the shoe 90 pushes the heat exchange basket 22 toward the air preheater. The ram 86 may consist of a single piece or pipe or a plurality of lengths of pipe that may be coupled together to allow the system to push the heat exchange basket 22 a greater distance.

Figure 3:
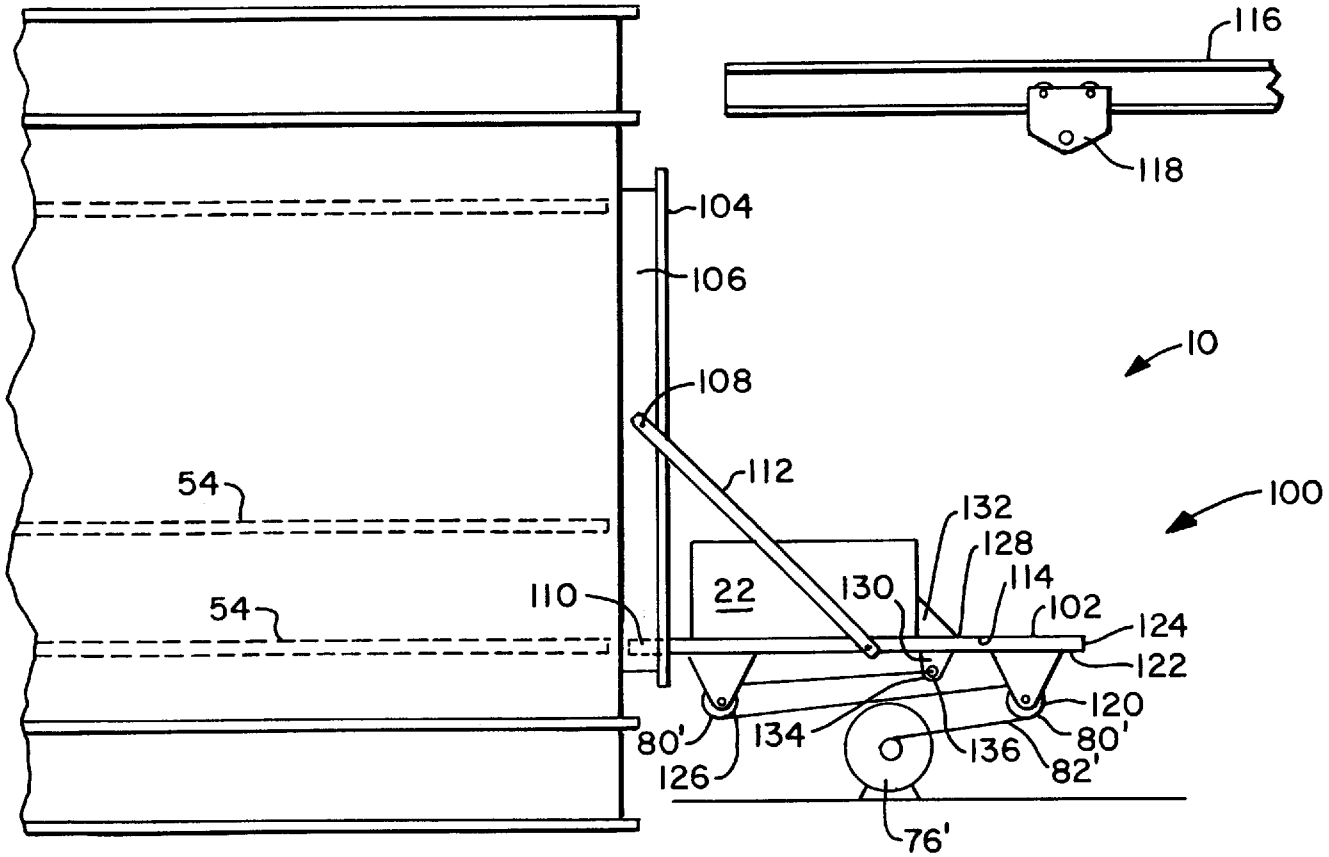
FIG. 3 is a schematic view of a second embodiment of a system for removal and replacement of basketed material within air preheater rotors, with a perspective view of the basket-removal door frame and a portion of the air preheater basket support structure shown in phantom, illustrating the basket replacement arrangement of the pulleys and shoe.
Figure 4:
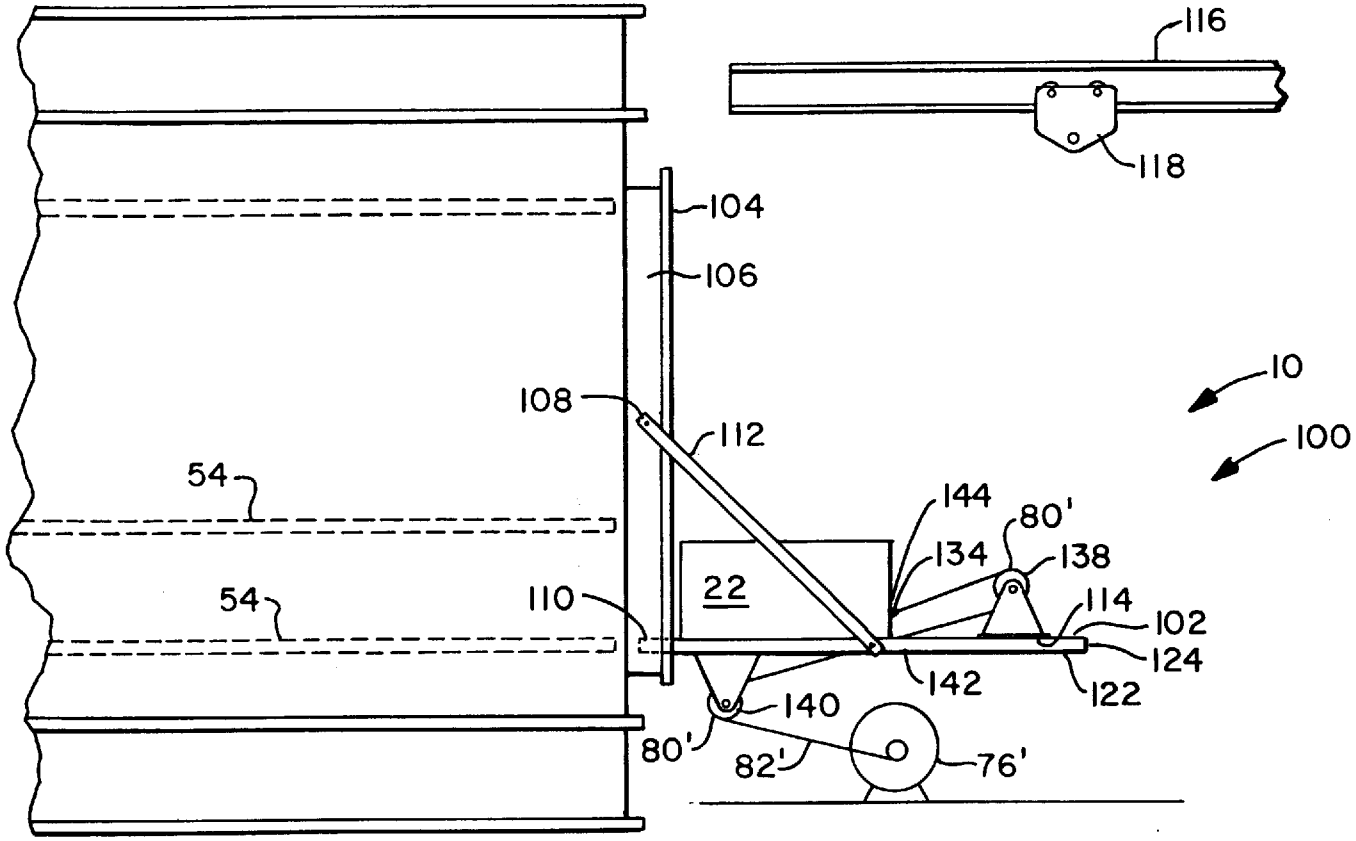
FIG. 4 is a schematic view of the system for removal and replacement of basketed material within air preheater rotors of FIG. 3, with a perspective view of the basket-removal door frame and a portion of the air preheater basket support structure in phantom, illustrating the basket removal arrangement of the pulleys and shoe.

In the embodiment 100 shown in FIGS. 3 and 4, the platform 102 is mounted to the basket removal opening frame 104. A plurality of mounting holes 106 in the frame 104 receive bolts 108 for mounting the front end 110 of the platform 102 and a platform brace 112 at different heights. The positions of the mounting holes 106 are selected such that the top surface 114 of the platform 102 may be substantially aligned with the internal basket supports 54 of the air preheater. An overhead rail 116 and trolley 118 provide a means for removing/supplying heat exchange baskets 22 to the platform 102.

The pulleys 80, 80' may be mounted to the platform 52, 102 of either embodiment 36, 100 in a manner that allows the tugger 76, 76' to push the heat exchange basket 22 into the air preheater without a 15 ram. As shown in FIG. 3, a first pulley 120 may be mounted to the bottom 122 of the platform 102 adjacent the rear end 124 and a second pulley 126 may be mounted to the bottom 122 of the platform 102 adjacent the front end 110. A slot 128 in the platform 102 extends from a point adjacent the first pulley 120 to a point adjacent the second pulley 126 and a mounting portion 130 of the shoe 132 extends downward through the slot 128. The free end 134 of the tugger line 82' is threaded around the first pulley 120 in a counterclockwise direction, around the second pulley 126 in a clockwise direction and is mounted to an eye 136 in the mounting portion 130 of the shoe 132. As the tugger 76' reels in the line 82', the shoe 132 is pulled toward the second pulley 126, pushing the heat exchange basket 22 toward the air preheater.

With reference to FIG. 4, two pulleys 138, 140 are also used to pull the heat exchange basket 22 from the air preheater. A first pulley 138 is mounted to the top 114 of the platform 102 adjacent the rear end 124 and a second pulley 140 is mounted to the bottom 122 of the platform 102 adjacent the front end 110. A slot 142 in the platform 102 extends from a point adjacent the first pulley 138 to a point adjacent the second pulley 140. The free end 134 of the tugger line 82' is threaded around the second pulley 140 in a clockwise direction, around the first pulley 138 in a counter-clockwise direction and is mounted to an eye 144 on the outboard surface of the heat exchange basket 22. As the tugger 76' reels in the line 82', the heat exchange basket 22 is pulled toward the first pulley 138, pulling the heat exchange basket 22 out of the air preheater.

It should be appreciated that the platform 52 of the first embodiment 36 may have a slot and pulleys may be mounted in a manner similar to that shown for the second embodiment 100.

I claim:

1. A system for removal and replacement of basketed materials for air preheaters having heat exchange baskets and a plurality of internal basket supports, the basket supports defining a plurality of basket support levels, the system comprising:

platform means comprising a platform having a horizontal upper surface for supporting the heat exchange baskets, the upper surface being substantially alignable with each basket support level;

tugger means for developing a motive force, the tugger means comprising a tugger line for transmitting the motive force;

engagement means engaged with the tugger line and engageable with a heat exchange basket for applying the motive force to the heat exchange basket; and pulley means contacting the tugger line for directing movement of the tugger line and thereby directing the motive force to either pull or push the heat exchange basket engaged by the engagement means;

wherein the motive force developed by the tugger means moves the heat exchange basket engaged by the engagement means either from one of the basket supports of the air preheater to the upper surface of the platform or from the upper surface of the platform to one of the basket supports of the air preheater.

2. The system of claim 1 wherein the platform further comprises first and second end portions and the platform means further comprises mounting means for removably mounting the second end portion of the platform to the air preheater.

3. The system of claim 2 wherein the mounting means comprises at least one hook, the hook having a first end portion pivotally mounted to the second end portion of the platform and a second end portion engageable with the air preheater.

4. The system of claim 2 wherein the mounting means comprise at least one brace and a plurality of fasteners, the brace having a first end mounted to the platform and a second end mountable to the air preheater by the fasteners, the second end portion of the platform also being mountable to the air preheater by the fasteners.

5. The system of claim 1 wherein the platform means, the tugger means and the pulley means define a unitary structure.

6. The system of claim 1 wherein the platform means further comprises a plurality of wheels, the platform further comprises oppositely disposed first and second ends and a lower surface, the tugger means comprises a tugger, and the pulley means comprises at least one pulley, wherein the wheels, the tugger and the pulley are mounted to the platform.

7. The system of claim 6 wherein the engagement means comprises a ram having oppositely disposed first and second ends and a shoe, the tugger line being engaged to the first end of the ram and the shoe being mounted on the second end of the ram, the platform means further comprising guide means for guiding movement of the ram.

8. The system of claim 7 wherein the tugger is mounted to the lower surface of the platform, the pulley is mounted to the first end of the platform, and the tugger line is disposed at least partially around the pulley, wherein the shoe is movable from a first position adjacent the first end of the platform to a second position adjacent the second end of the platform when the tugger reels in the tugger line.

9. The system of claim 1 wherein the platform further comprises oppositely disposed first and second ends and a lower surface.

10. The system of claim 9 wherein the platform defines a longitudinally extending slot and the pulley means comprises a first pulley mounted to the upper surface of the first end of the platform and a second pulley mounted to the lower surface of the second end of the platform, the tugger line being disposed at least partially around the first and second pulleys and extending through the slot, wherein the engagement means is movable from a first position adjacent the second end of the platform to a second position adjacent the first pulley when the tugger reels in the tugger line.

11. The system of claim 9 wherein the platform defines a longitudinally extending slot, the engagement means comprises a shoe portion disposed above the upper surface of the platform and a mounting portion extending downwardly through the slot, and the pulley means comprises a first pulley mounted to the lower surface of the first end of the platform and a second pulley mounted to the lower surface of the second end of the platform, the tugger line being disposed at least partially around the first and second pulleys, wherein the engagement means is movable from a first position adjacent the first end of the platform to a second position adjacent the second end of the platform when the tugger reels in the tugger line.

12. A system for removal and replacement of basketed materials for air preheaters having heat exchange baskets and a plurality of internal basket supports, the basket supports defining a plurality of basket support levels, the system comprising a unitary cart including:

a platform having substantially horizontal upper and lower surfaces, the upper surface being substantially alignable with each basket support level;

tugger means mounted to the platform for developing a motive force, the tugger means comprising a tugger line for transmitting the motive force;

engagement means engaged with the tugger line and engageable with a heat exchange basket for applying the motive force to the heat exchange basket; and pulley means mounted to the platform for directing the motive force to either pull or push the heat exchange basket engaged by the engagement means;

wherein the motive force developed by the tugger means moves the heat exchange basket engaged by the engagement means either from one of the basket supports of the air preheater to the horizontal surface of the platform or from the horizontal surface of the platform to one of the basket supports of the air preheater.

13. The system of claim 12 wherein the platform comprises first and second end portions and the system further comprises mounting means for removably mounting the second end portion of the platform to the air preheater.

14. The system of claim 13 wherein the mounting means comprises at least one hook, the hook having a first end portion pivotally mounted to the second end portion of the platform and a second end portion engageable with the air preheater.

15. The system of claim 12 wherein the engagement means comprises a ram having oppositely disposed first and second ends and a shoe, the tugger line being disposed at least partially around the pulley and engaged to the first end of the ram, the shoe being mounted to the second end of the ram, wherein the shoe is movable from a first position adjacent the first end of the platform to a second position adjacent the second end of the platform when the tugger reels in the tugger line.

16. A system for removal and replacement of basketed materials for air preheaters having heat exchange baskets, a plurality of internal basket supports, and door frame defining a plurality of vertically spaced openings, the basket supports defining a plurality of basket support levels, the system comprising:

platform means comprising a platform having oppositely disposed first and second end portions and a substantially horizontal upper surface for supporting the heat exchange baskets and a lower surface, the second end portion being mountable to the air preheater and the upper surface being substantially alignable with each basket support level;

tugger means for developing a motive force, the tugger means comprising a tugger line for transmitting the motive force;

engagement means engaged with the tugger line and engageable with a heat exchange basket for applying the motive force to the heat exchange basket; and pulley means contacting the tugger line for directing movement of the tugger line and thereby directing the motive force to either pull or push the heat exchange basket engaged by the engagement means;

wherein the motive force developed by the tugger means moves the heat exchange basket engaged by the engagement means either from one of the basket supports of the air preheater to the upper surface of the platform or from the upper surface of the platform to one of the basket supports of the air preheater.

17. The system of claim 16 further comprising mounting means for mounting the platform to the air preheater including at least one brace and a plurality of fasteners, the brace having a first end mounted to the platform and a second end defining an opening, the second end portion of the platform defining an opening, a fastener being disposed through the opening of the second end of the brace and an opening in the door frame and a fastener being disposed through the opening of the second end portion of the platform and an opening in the door frame to mount the platform to the air preheater.

18. The system of claim 16 wherein the platform defines a longitudinally extending slot and the pulley means comprises a first pulley mounted to the upper surface of the first end portion of the and a second pulley mounted to the lower surface of the second end portion of the platform, the tugger line being disposed at least partially around the first and second pulleys and through the slot, wherein the engagement means is movable from a first position adjacent the second end of the platform to a second position adjacent the first pulley when the tugger reels in the tugger line.

19. The system of claim 16 wherein the platform defines a longitudinally extending slot, the engagement means comprises a shoe portion disposed above the upper surface of the platform and a mounting portion extending downwardly through the slot, and the pulley means comprises a first pulley mounted to the lower surface of first end portion of the platform and a second pulley mounted to the lower surface of the second end portion of the platform, the tugger line being disposed at least partially around the first and second pulleys, wherein the engagement means is movable from a first position adjacent the first end of the platform to a second position adjacent the second end of the platform when the tugger reels in the tugger line.

* * * * *